US005352552A

United States Patent [19]

Maruyama et al.

[11] Patent Number: 5,352,552

[45] Date of Patent: Oct. 4, 1994

[54] IMAGE-BEARING MEMBER AND APPARATUS INCLUDING SAME

[75] Inventors: Akio Maruyama, Tokyo; Naoto Fujimura, Yokohama; Kiyoshi Sakai, Hachiohji; Shin Nagahara, Tokyo; Noriko Ohtani, Yokohama; Seiko Nakano, Tsu, all of Japan

[73] Assignee: Canon Kabushiki Kaisha, Tokyo, Japan

[21] Appl. No.: 840,532

[22] Filed: Feb. 25, 1992

[30] Foreign Application Priority Data

Feb. 27, 1991 [JP] Japan ..... 3-053494

[51] Int. Cl.[5] ..... G03G 5/147; G03G 15/00

[52] U.S. Cl. ..... 430/18; 430/58; 430/66; 430/67; 355/211; 358/300; 358/302

[58] Field of Search ..... 430/18, 58, 66, 67, 430/532; 355/211; 358/300, 302

[56] References Cited

U.S. PATENT DOCUMENTS

| | | | |
|---|---|---|---|
| 3,865,588 | 2/1975 | Ohto et al. | 430/18 |
| 4,296,190 | 10/1981 | Hasegawa et al. | 430/57 |
| 4,362,799 | 12/1982 | Kondo et al. | 430/67 |
| 4,477,548 | 10/1984 | Harasta et al. | 430/18 X |
| 4,960,661 | 1/1990 | Kato et al. | 430/49 |
| 5,178,996 | 1/1993 | Kobayashi et al. | 430/532 |

FOREIGN PATENT DOCUMENTS

| | | | |
|---|---|---|---|
| 326169 | 8/1989 | European Pat. Off. . | |
| 443626 | 8/1991 | European Pat. Off. . | |
| 460558 | 12/1991 | European Pat. Off. . | |
| 464749 | 1/1992 | European Pat. Off. . | |
| 89843 | 7/1980 | Japan | 430/67 |
| 60-5535 | 3/1985 | Japan . | |
| 60-55355 | 3/1985 | Japan . | |
| 271270 | 11/1988 | Japan | 430/66 |

OTHER PUBLICATIONS

Patent Abstracts of Japan, vol. 8, No. 48 (P-258) [1485] Mar. 3, 1984.

Patent Abstracts of Japan, vol. 9, No. 54 (P-340) [1777] Mar. 8, 1985.

Patent Abstracts of Japan, vol. 13, No. 357 (P-915) [3705] Aug. 10, 1989.

*Primary Examiner*—Roland Martin

*Attorney, Agent, or Firm*—Fitzpatrick, Cella, Harper & Scinto

[57] ABSTRACT

An image-bearing member suitable for carrying an electrostatic image and/or a toner image is formed by forming a surface layer on a substrate or a photosensitive layer. The surface layer comprises a polymerized and cured product of a photoionically polymerizable compound having two or more functional groups, and shows excellent mechanical and electrical resistance as well as excellent charge-retaining characteristic. As a result, the surface layer provides an image-bearing surface suitable for electrophotography. The surface layer may be a protective layer or a photoconductive layer when it constitutes a photosensitive member.

15 Claims, 2 Drawing Sheets

IMAGE-BEARING MEMBER AND APPARATUS INCLUDING SAME

FIELD OF THE INVENTION AND RELATED ART

The present invention relates to an image-bearing member for carrying an electrostatic image and/or a toner image, more particularly to such an image-bearing member having an excellent durability including excellent wet resistance and stain resistance and an apparatus including the image-bearing member.

An electrostatic image or a toner image is formed in various processes. Image-bearing members carrying such an electrostatic image or a toner image include an image-bearing member having a photoconductive layer, called a photosensitive member for electrophotography, and an image bearing member having no photoconductive layer. In any case, the image-bearing members generally comprise a support and an image-bearing layer formed thereon.

The photosensitive member for electrophotography may take various forms so as to attain desired characteristics or depending on the kinds of electrophotographic processes applied thereto. Representative photosensitive members for electrophotography may include one comprising a photoconductive layer formed on a support and one further including a surface layer thereon which have been widely used. The photosensitive member comprising a support and a photoconductive layer may be used for image formation by the most popular electrophotographic process including charging, imagewise exposure, development and further transfer as desired. As for the photosensitive member provided with a surface layer, such a surface layer may be provided for the purpose of, e.g., protecting the photoconductive layer, improving the mechanical strength of the photosensitive member, or improving the dark decay characteristic.

An electrostatic image is formed on an electrophotographic photosensitive member by application of a prescribed electrophotographic process, and the electrostatic image is visualized by development.

The image bearing member having no photoconductive layer typically comprises an insulating layer as its image-bearing layer and may be used in the following processes as representative.

(1) In order to improve the repetitive usability of an electrophotographic photosensitive member, an electrostatic image formed on the electrophotographic photosensitive member is transferred to another image-bearing member for development, and the resultant toner image is transferred to a recording member as disclosed in, e.g., Japanese Patent Publications (JP-B) 52-7115, 52-8204 and 45-1559. (2) In another electrophotographic process involving forming an electrostatic image on another image-bearing member having no photoconductive layer corresponding to an electrostatic image formed on an electrophotographic photosensitive member, an electrostatic image is formed on an electrophotographic photosensitive member in the form of a screen having a large number of minute openings through a prescribed electrophotographic process, a corona charging treatment is applied to another image-bearing member by the medium of the electrostatic image to modulate the corona ion stream thereby forming an electrostatic image on the above-mentioned another image-bearing member, and the electrostatic image is developed with a toner and transferred to a recording member to form a final image (as disclosed in JP-B 45-30320, JP-B 48-5063 and Japanese Laid-Open Patent Application JP-A, 51-341). (3) According to another electrophotographic process, a toner image formed on an electrophotographic photosensitive member or another image-bearing member having no photoconductive layer is not directly transferred to a recording member but is transferred to still another image-bearing member having no photoconductive layer, and the toner image is then transferred to a recording member to be fixed thereon. This process is particularly effective for production of color images and high-speed copying. The recording member may ordinarily be a flexible material, such as paper or film. Accordingly, rather than transferring three color images directly to a recording member with precise positional alignment, a more accurately aligned color image can be formed if three color images are transferred onto an image-bearing member composed of a material substantially free from deformation and then transferred to a recording member one at a time. Further, the transfer of a toner image to a recording member by the medium of an image-bearing member is also effective for high-speed copying. (4) In another process, an electric signal is applied to a multistylus electrode to form an electrostatic image on an image-bearing member corresponding to the electric signal, and the electrostatic image is developed to provide an image.

The image-bearing member used in electrophotography is subjected to various electrical and mechanical shock so that it is liable to be damaged. Once the image-bearing member is damaged, the resultant image quality is remarkably lowered. Accordingly, an image-bearing member having excellent resistance to electrical and mechanical shock and excellent charge-retaining characteristic is strongly desired.

In order to satisfy the characteristics desired of an image-bearing member, it has been proposed to dispose surface layers comprising various protective resins on image-bearing members, e.g., as disclosed in JP-A 60-55355 and 60-55356. It has not yet been possible to provide a surface layer having excellent lubricity, hardness and abrasive characteristic, and also satisfactory levels of sensitivity, residual potential and chargeability.

For example, if the surface layer formed on a photoconductive layer has too high a resistivity, there results a residual potential due to the surface layer in the electrophotographic process and thus image defects such as fog occur upon repetitive use. It is an important problem to control the resistivity of the surface layer, thus preventing occurrence of a residual potential.

SUMMARY OF THE INVENTION

An object of the present invention is to provide an image-bearing member satisfying the above-mentioned requirements.

More specifically, an object of the present invention is to provide an image-bearing member having a durability against surface wearing or occurrence of damage due to rubbing and excellent surface lubricity.

Another object of the present invention is to provide an electrophotographic photosensitive member which is not liable to cause accumulation of a residual potential and can produce high-quality images over a whole period of image formation on a large number of sheets.

A further object of the present invention is to provide an apparatus including such an electrophotographic apparatus.

According to the present invention, there is provided an image-bearing member having a surface layer comprising a polymerization and curing product of a photoionically polymerizable compound having two or more functional groups.

Because of the coverage with its surface layer, the image-bearing member according to the present invention shows excellent sensitivity, residual potential characteristic and chargeability, and also excellent surface lubricity, wear-resistance and hardness, so that it can stably provide good images even in repetitive and successive use.

Further, an electrophotographic photosensitive member, i.e., an image-bearing member including a photosensitive layer, is free from problems in sensitivity or residual potential, thus being capable of providing good images even after successive use.

Further, the electrophotographic photosensitive member according to the present invention does not cause substantial deterioration of the photoconductor under a charger, so that it can effectively prevent partial lowering in chargeability or partial increase in sensitivity.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
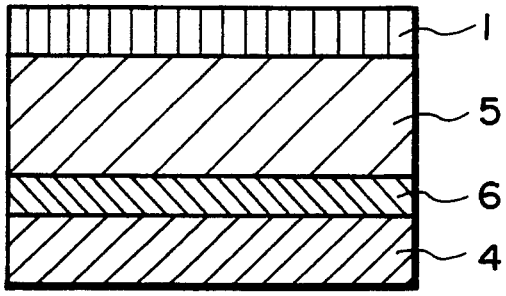
Figure 3:
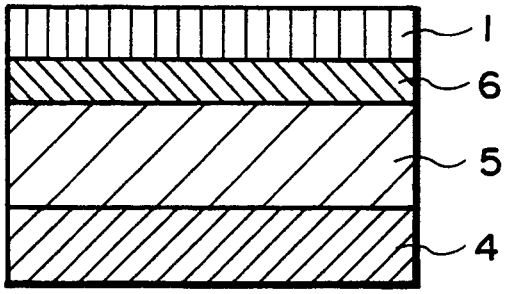

The image-bearing member according to the present invention will now be explained with respect to some embodiments thereof with reference to the drawings wherein like reference numerals denote like parts. More specifically, FIGS. 1–3 are schematic sectional views showing embodiments of the image-bearing member according to the present invention which respectively include a protective layer as the surface layer.

Figure 1:
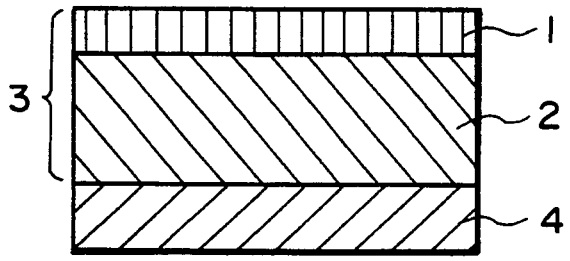
FIGS. 1 through 3 are respectively a schematic sectional view of an embodiment of the image-bearing member according to the present invention.

Referring to FIG. 1, the image-bearing member includes a protective layer 1 disposed as the outermost layer thereof to protect the inner layers, a photoconductive layer 2 which can be omitted from the image-bearing member of the present invention in some cases as described above, and a support 4. The layers 1 and 2 may be inclusively referred to as an image-bearing layer 3. The photoconductive layer 2 can be formed as a laminate including a charge transport layer 5 and a charge generation layer 6 which may be disposed in an arbitrary order on the support 4 as shown in FIGS. 2 and 3.

The surface layer used as a protective layer according to the present invention is characterized by comprising a resin obtained through polymerization and curing of a photoionically polymerizable compound having two or more functional groups. The photoionic polymerization is not susceptible to hindrance with oxygen so that it can provide a higher polymerization degree at the surface than the radical polymerization. Accordingly, the resultant surface layer is provided with excellent surface lubricity and scratch hardness.

In the present invention, the photoionically polymerized product may constitute 2–100 wt. %, preferably 20–100 wt. %, of the protective layer. The protective layer may have a thickness of 0.1–5 microns, preferably 0.1–2 microns. If the thickness is below 0.1 micron, the protective layer is accompanied with a problem in durability and, above 5 microns, there results in a high residual potential.

The thus produced protective layer is excellent in mechanical strength and also in transparency, hardness, lubricity and wear resistance.

Particularly, in the case where the photosensitive layer assumes a laminate structure including a charge generation layer 6 and a charge transport layer 5 disposed in this order on a support 4 as shown in FIG. 2, a further decrease in residual potential and an increase in sensitivity as a whole can be accomplished while retaining the hardness, lubricity and wear resistance of the surface layer or protective layer 1, if the charge transport substance in the charge transport layer 5 is caused to penetrate into the surface protective layer 1 comprising a resin obtained by polymerization and curing of a photoionically polymerizable compound having two or more functional groups. In order to cause the charge transport substance to penetrate into the protective layer, various methods may be applicable, including, for example, a method of using a coating liquid for the protective layer containing a solvent capable of dissolving the charge transport substance or a method of applying the coating liquid for the protective layer and drying the applied layer at a temperature not lower than the glass transition temperature of the charge transport layer resin. These are not limitative, however.

The coating liquid for the protective layer according to the present invention comprises a photoionically polymerizable compound having two or more functional groups.

Examples of monomer (unit) structures including such a photoionically polymerizable functional group are enumerated in Table 1 below.

TABLE 1

| Name | Monomer structure | Polymer structure |
|---|---|---|
| | | (n: integer) |
| [epoxies] | 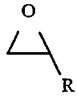 | 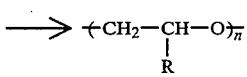 |
| | | (R: organic group, such as alkyl or aryl) |

TABLE 1-continued

| Name | Monomer structure | Polymer structure |
|---|---|---|
| [Vinyl ethers] | $CH{=}CH_2$ (O, R) | $\rightarrow$ $\leftarrow CH(O{-}R){-}CH_2 \rightarrow_n$ |
| | (R: organic group, such as alkyl or aryl) | |
| [vinyls having a polar group] | $CH{=}CH_2$ (R) | $\rightarrow$ $\leftarrow CH(R){-}CH_2 \rightarrow_n$ |
| | (R: electron-donative or -attractive group, such as alkoxy and halogen) | |
| [cyclic ethers] | 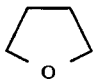 | $\rightarrow$ $\leftarrow (CH_2)_4{-}O \rightarrow_n$ |
| | 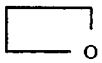 | $\rightarrow$ $\leftarrow (CH_2)_3{-}O \rightarrow_n$ |
| | 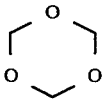 | $\rightarrow$ $[CH_2{-}O]_n$ |
| | 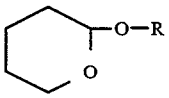 | $\rightarrow$ $\leftarrow (CH_2)_4{-}C(=O) \rightarrow_n$ |
| | (R: organic groups, such as alkyl or aryl) | |
| | 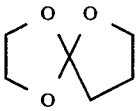 | $\rightarrow$ $\leftarrow O{-}\leftarrow (CH_2)_2{-}OC(=O){-}(CH_2)_2 \rightarrow_n$ |
| [thioxysilane rings] | 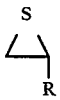 | $\rightarrow$ $\leftarrow CH_2{-}CH(R){-}S \rightarrow_n$ |
| | (R: organic groups, such as alkyl or aryl) | |
| [cyclic organopolysiloxanes] | 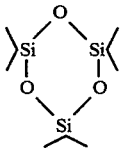 | $\rightarrow$ $\leftarrow Si(R_2){-}O \rightarrow_n$ |

Such functional groups cause polymerization under photoirradiation, preferably in the presence of a photopolymerization initiator. Accordingly, the photoionically polymerizable compounds used in the present invention refer to compounds having two or more of such photoionically polymerizable functional groups. Examples thereof are enumerated in Table 2 shown below, but they are not exhaustive and some of commercially available two or more-functional photoionically polymerizable compounds may also be used.

TABLE 2

| No. | Structural Formula | Number of functional groups |
|---|---|---|
| 1 | 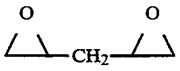 | 2 |
| 2 | 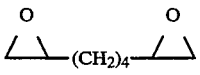 | 2 |

TABLE 2-continued
| No. | Structural Formula | Number of functional groups |
|---|---|---|
| 3 | 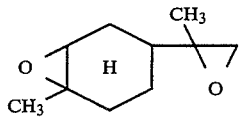 | 2 |
| 4 | 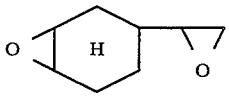 | 2 |
| 5 | 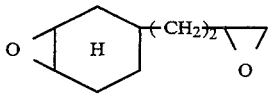 | 2 |
| 6 | 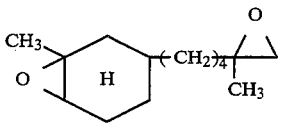 | 2 |
| 7 | 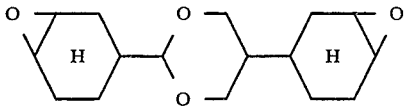 | 2 |
| 8 | 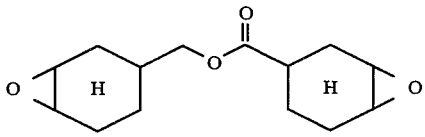 | 2 |
| 9 | 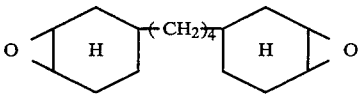 | 2 |
| 10 | 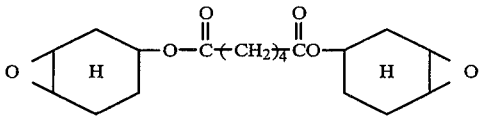 | 2 |
| 11 | 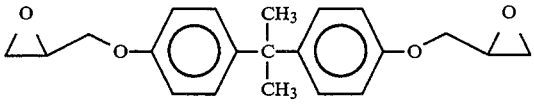 | 2 |
| 12 | 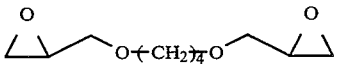 | 2 |
| 13 | 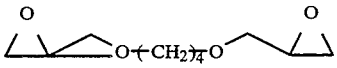 | 2 |
| 14 | 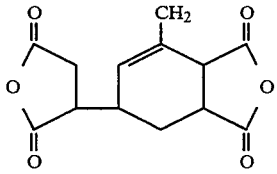 | 2 |

TABLE 2-continued
| No. | Structural Formula | Number of functional groups |
|---|---|---|
| 15 | 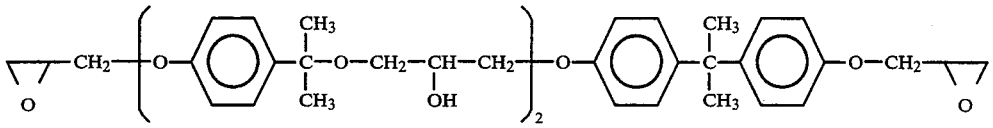 | 2 |
| 16 | 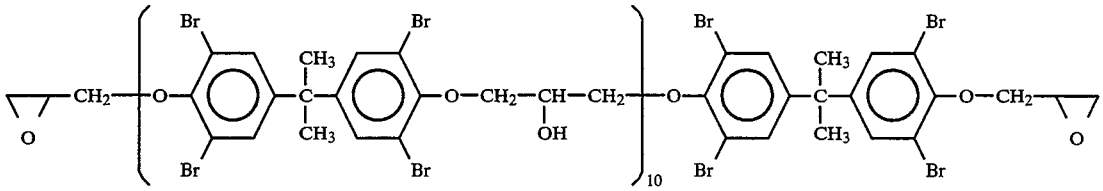 | 2 |
| 17 | 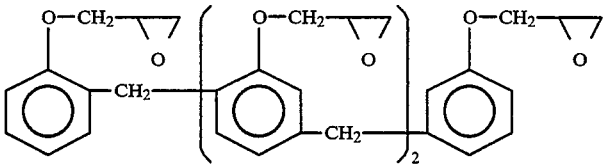 | 4 |
| 18 | 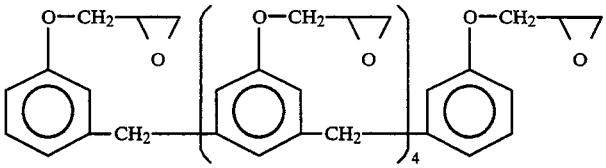 | 6 |
| 19 | 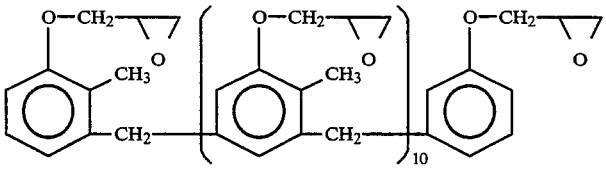 | 12 |
| 20 | 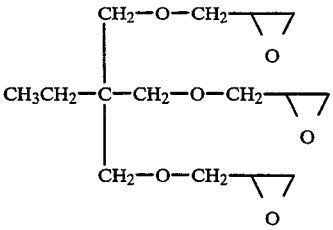 | 3 |
| 21 | 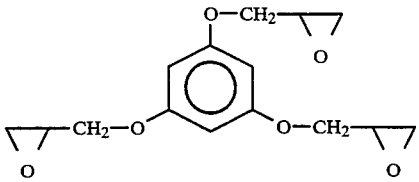 | 3 |
| 22 | 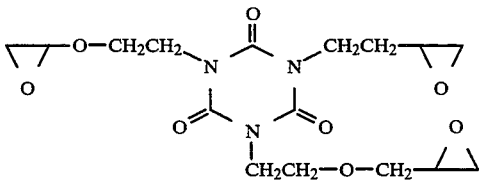 | 3 |

TABLE 2-continued

| No. | Structural Formula | Number of functional groups |
|---|---|---|
| 23 | 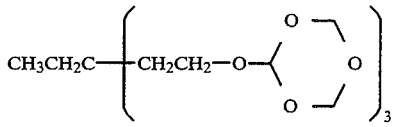 | 3 |
| 24 | 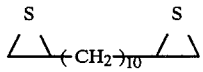 | 2 |
| 25 | 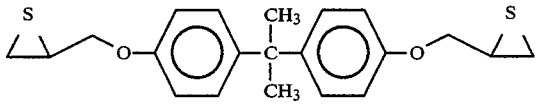 | 2 |
| 26 | 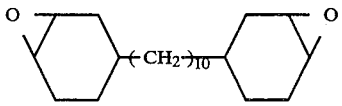 | 2 |
| 27 | 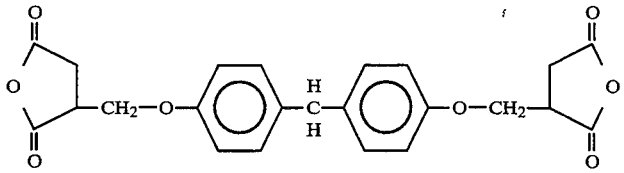 | 2 |

These photoionically polymerizable compounds may be used singly or in mixtures of two or more species thereof or with another resin, examples of which may include: polyester, polycarbonate, polystyrene, polyvinyl chloride, cellulose resin, fluorine-containing resin, polyethylene, polypropylene, polyurethane, acrylic resin, epoxy resin, silicone, alkyd resin and vinyl chloride-vinyl acetate copolymer resin.

The photoionically polymerizable compound can be used in dilution with a monofunctional epoxy compound to an extent that does not lower the curing characteristic. Examples of such a monofunctional epoxy diluent may include phenyl glycidyl ether and t-butyl glycidyl ether.

The photocuring of the protective layer may be performed in the presence of a photopolymerization initiator. A type of photopolymerization initiator that liberates a Lewis acid upon ultraviolet irradiation, to initiate the polymerization of a cationically polymerizable compound, may include: aromatic diazonium salts, aromatic halonium salts and photosensitive aromatic onium salts of the VIb or Vb group elements.

The aromatic diazonium salts may be represented by the following general formula (I):

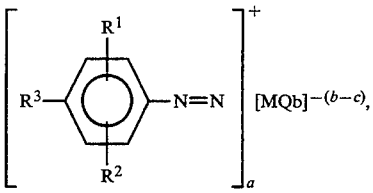

(I)

wherein $R^1$ and $R^2$ denote a hydrogen atom, an alkyl group or an alkoxy group; $R^3$ denotes a hydrogen atom, an aromatic group, an amide group or an aromatic group linked by a sulfur atom; M denotes a metal or a metalloid; Q denotes a halogen atom; a is a number of 1–6 satisfying the equation of $a=(b-c)$, b is a number satisfying the relation of $c<b\leqq 8$, and c is a number of 2–7 equal to the valence of M.

Specific examples thereof may include the following:

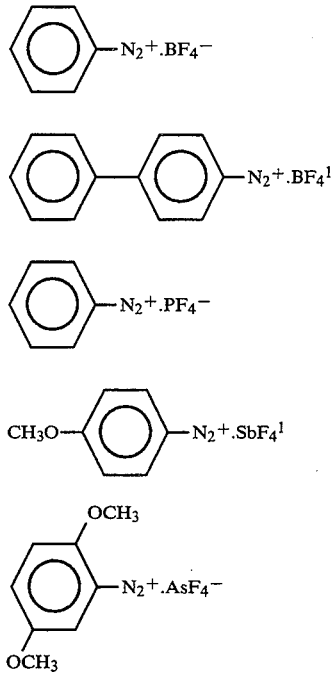

-continued

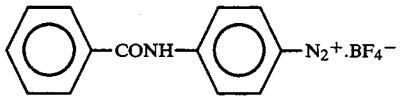

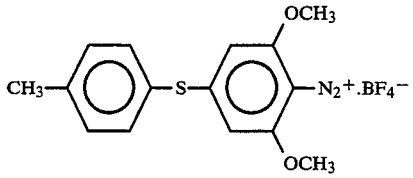

The above-mentioned aromatic onium salts may be represented by the following general formula (II):

$$[(R^4)_d(R^5)_eX]_f^+[MQ_g]^{-(g-h)} \quad \text{(II)},$$

wherein $R^4$ denotes a monovalent aromatic organic group, $R^5$ denotes a divalent aromatic organic group, X denotes a halogen atom, such as I, Br or Cl, M denotes a metal or metalloid, Q denotes a halogen atom, d is 0 or 2, e is 0 or 1, g is a number satisfying the relation of $h<g\leqq 8$, h is a number of 2–7 equal to the valence of M, and (d+e) is equal to 2 or the valence of X.

Specific examples thereof may include the following:

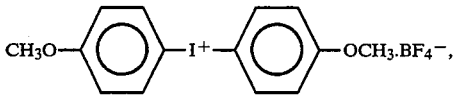

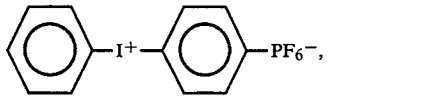

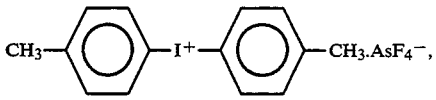

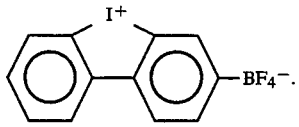

The above-mentioned photosensitive aromatic onium salts of the VIb or Vb elements may be represented by the following formula (III):

$$[(R^6)_i(R^7)_d(R^8)_kY]_1^+[MQ_m]^{-(m-n)} \quad \text{(III)},$$

wherein $R^6$ denotes a monovalent aromatic organic group, $R^7$ denotes a monovalent aliphatic organic group selected from an alkyl group, a cycloalkyl group and a substituted alkyl group, $R^8$ denotes a polyvalent aliphatic or aromatic organic group having a heterocyclic ring structure; Y denotes a VIb group element of S, Se or Te or a Vb group element of N, P, As, Sb or Bi; M denotes a metal or a metalloid; Q denotes a halogen atom; i is an integer of 0–4, j is an integer of 0–2, and k is an integer of 0–2 with proviso that (i+j+k) is equal to the valence of Y which is 3 when Y is a VIb group element or 4 when Y is a Vb group element, i=(m−n), m is a number satisfying the relation of $n<m\leqq 8$, and n is a number of 2–7 equal to the valence of M.

The onium salts of the VIb group elements may include the following:

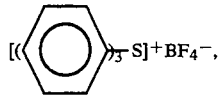

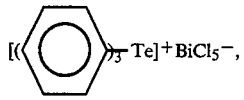

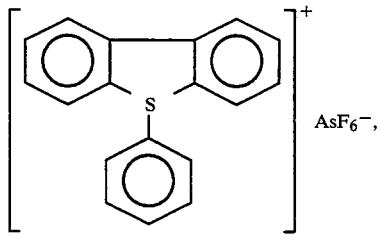

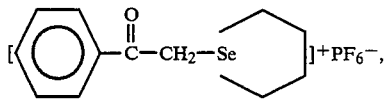

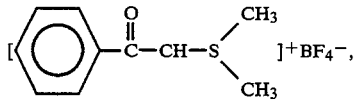

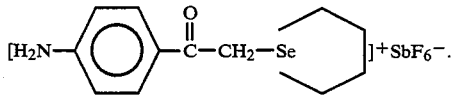

Further, the onium salts of the Vb group elements may include the following:

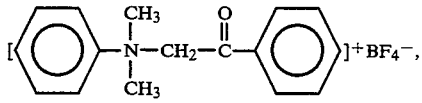

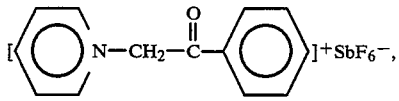

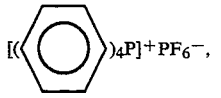

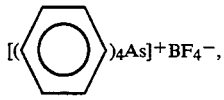

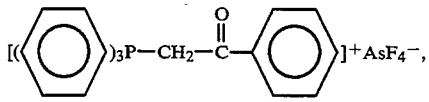

-continued

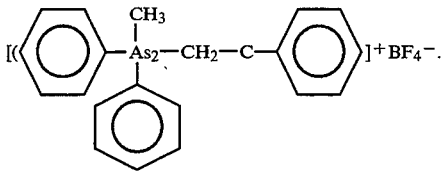

The ultraviolet rays for polymerizing and curing the photoionically polymerizable compound may have a wavelength of generally 200–500 nm, preferably 300–400 nm. The light source may generally be high-pressure or low-pressure mercury lamp, xenon lamp or alkali halide lamp. It is possible to heat the image-bearing member to be irradiated during and/or after the irradiation with ultraviolet rays as desired.

The support 4 used in the present invention may preferably be an electroconductive one, examples of which may include: metals per se, such as aluminum or stainless steel; plastic film coated with aluminum, aluminum oxide or indium oxide vapor-deposited thereon; and metal film or plastic film coated with an electroconductive substance, such as titanium oxide or tin oxide, alone or in admixture with an appropriate binder resin. It is also possible to form a primer layer having a barrier function or an adhesive function between the support and the photoconductive layer. The primer layer may for example be formed from casein, polyvinyl alcohol, alcohol-soluble polyamides, polyurethane, nylon, gelatin, or aluminum oxide, and may suitably have a thickness of 0.1–5 microns, preferably 0.2–2 microns.

As described above, the photosensitive layer used in the present invention may comprise a single layer 2 (as shown in FIG. 1) or a laminate including a charge generation layer 6 and a charge transport layer 5 (as shown in FIGS. 2 and 3). In the case of the laminate structure type, the laminate structure including the charge generation layer 6 as an upper layer (as shown in FIG. 3) may suitably be used a photosensitive member to be charged positively and the laminate structure including the charge generation layer 6 as a lower layer (as shown in FIG. 2) may suitably be used as a photosensitive member to be charged negatively.

The charge generation layer 6 may be formed by dispersing a charge generation substance selected from pyrylium and thiopyrylium dyes, phthalocyanine pigments, anthoanthrone pigments, dibenzpyrenequinone pigments, trisazo pigments, disazo pigments, azo pigments and indigo pigments in a binder resin, such as polyvinyl butyral, polystyrene, acrylic resin or polyester. The charge generation layer may have a thickness of generally 5 microns or less, preferably 0.05–2 microns.

The charge transport layer 5 may be formed by dissolving a charge transport substance selected from polycyclic aromatic compounds having a structure, such as biphenylene, anthracene, pyrene or phenanthrene in their main chain or side chain, nitrogen-containing cyclic compounds such as indole, carbazole, oxadiazole and pyrazoline, hydrazone compounds and styryl compounds in a binder resin, such as polycarbonate, polyester, polymethacrylate or polystyrene. The charge transport layer may have a thickness of 5–40 microns, preferably 10–30 microns.

In the present invention, it is also possible to use a layer of an organic photoconductor such as polyvinyl carbazole, polyvinylanthracene or polysilane, selenium deposition layer, selenium-tellurium deposition layer, or amorphous silicon layer as the photosensitive layer.

The image-bearing member or electrophotographic photosensitive men%her according to the present invention may be applicable to electrophotographic apparatus in general including copying machines, laser printers, LED printers and liquid crystal-shutter printers, and also applicable to fields of applied electrophotography including display, recording, mini-scale printing, plate production and facsimile apparatus.

Figure 4:
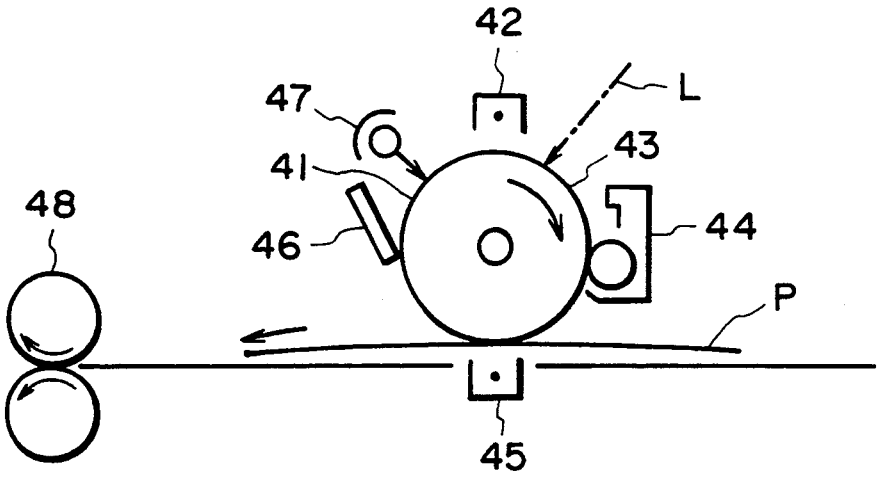
FIG. 4 is a schematic view illustrating the outline of a transfer-type electrophotographic apparatus equipped with an electrophotographic photosensitive member in the form of an ordinary drum.

FIG. 4 shows an outline of an ordinary transfer-type electrophotographic apparatus including an image-bearing men%her according to the present invention in the form of a photosensitive drum.

Referring to FIG. 4, the apparatus includes a drum-shaped photosensitive member 41 as an image-bearing member which rotates about an its axis at a prescribed peripheral speed in the direction of the arrow. In the course of the rotation, the peripheral surface of the photosensitive member 41 is uniformly charged to a positive or negative prescribed potential by a charging means 42 and then exposed to image light L by an imagewise exposure means (not shown, such as slit exposure means or laser beam scanning exposure means) at an exposure position 43. As a result, an electrostatic latent image corresponding to the exposure light image is sequentially formed on the peripheral surface of the photosensitive member.

The electrostatic latent image is then developed with a toner by a developing means 44, and the resultant toner image is sequentially transferred by a transfer means 45 onto a transfer material or paper P which has been supplied between the photosensitive member 41 and the transfer means 45 in synchronism with the rotation of the photosensitive member 41 by a paper-supplying unit (not shown).

The transfer material P having received the toner image is separated from the photosensitive member surface and introduced to an image fixing means 48 for image fixation to be discharged as a copy product out of the apparatus.

The surface of the photosensitive member 41 after the image transfer is subjected to removal of transfer-residual toner by a cleaning means 46 to be cleaned and used for repetitive image formation.

A corona charging device is widely used in general as the uniform charging means 42 for the photosensitive member 41. A corona transfer means is also widely used in general as the transfer means 45.

In the electrophotographic apparatus, plural members including some of the above-mentioned photosensitive member 41, developing means 44, cleaning means 46, etc., can be integrally combined to form an apparatus unit so that the unit can be readily connected to or released from the apparatus body. For example, the photosensitive member 41 and the cleaning means 46 can be integrated into a single unit so that it can be attached to or released from the apparatus body by a guide means such as a guide rail provided to the apparatus body. In this instance, the apparatus unit can also be integrally accompanied with the charging means 42 and/or the developing means 44.

In a case where the electrophotographic apparatus is used as a copying machine or a printer, the image light L is a reflected light or transmitted light from an original, or an image light formed by coding read data from an original and scanning a laser beam or driving a lightemitting diode array or a liquid crystal shutter array based on the coded data.

Figure 5:
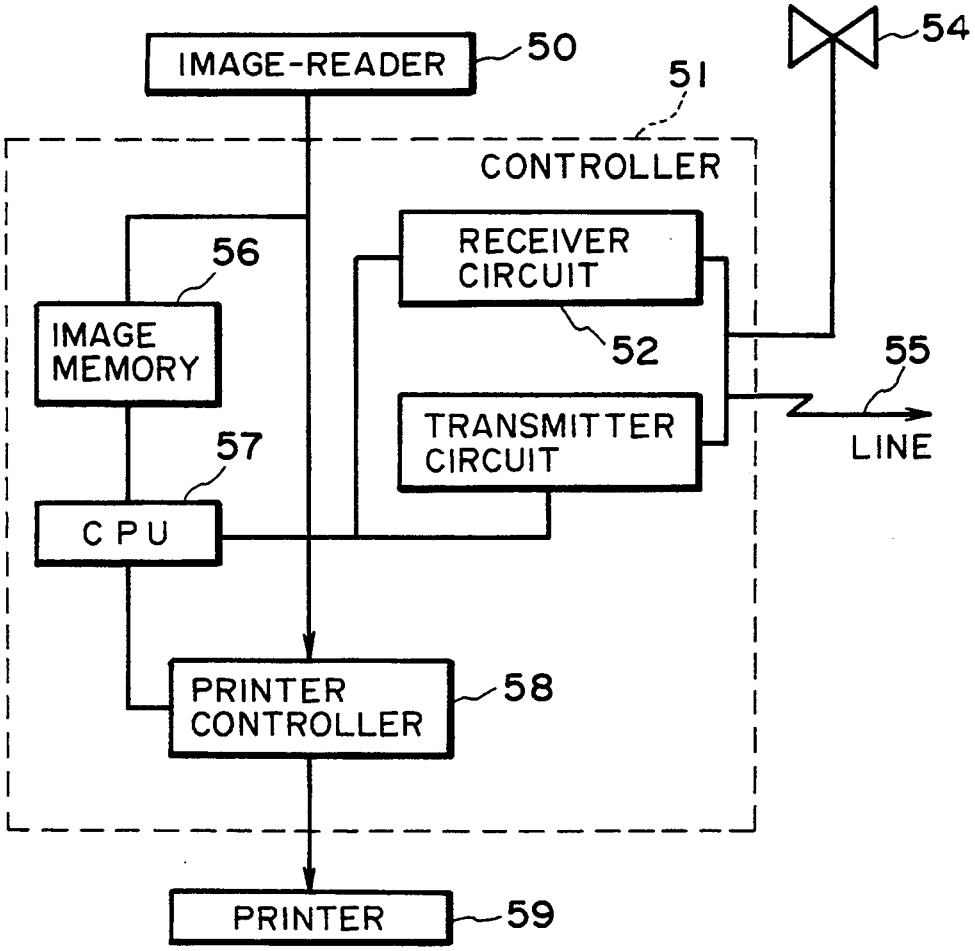
FIG. 5 is a block diagram of a facsimile system including such an electrophotographic apparatus as a printer.

In a case where the image forming apparatus is used as a printer for facsimile, the image light L may be replaced by exposure light image for printing received data. FIG. 5 is a block diagram for illustrating such an embodiment.

Referring to FIG. 5, a controller 51 controls an image reader (or image reading unit) 50 and a printer 59. The entirety of the controller 51 is regulated by a CPU 57. Data read from the image reader 50 is transmitted through a transmitter circuit 53 to a remote terminal such as another facsimile machine. On the other hand, data received from a remote terminal is transmitted through a receiver circuit 52 to a printer 59. An image memory 56 stores prescribed image data. A printer controller 58 controls the printer 59. A telephone handset 54 is connected to the receiver circuit 52 and the transmitter circuit 53.

More specifically, an image received from a line (or circuit) 55 (i.e., image data received from a remote terminal connected by the line) is demodulated by means of the receiver circuit 52, decoded by the CPU 57, and sequentially stored in the image memory 56. When image data corresponding to at least one page is stored in the image memory 56, image recording or output is effected with respect to the corresponding page. The CPU 57 reads image data corresponding to one page from the image memory 56, and transmits the decoded data corresponding to one page to the printer controller 58. When the printer controller 58 receives the image data corresponding to one page from the CPU 57, the printer controller 58 controls the printer 59 so that image data recording corresponding to the page is effected. During the recording by the printer 59, the CPU 57 receives another image data corresponding to the next page.

Thus, receiving and recording of an image may be effected in the above-described manner by using an electrophotographic apparatus equipped with an image-bearing member according to the present invention as a printer.

Hereinbelow, the present invention described more specifically based on Examples wherein "part(s)" is used to mean "part(s) by weight".

EXAMPLE 1

50 parts of electroconductive titanium oxide powder coated with tin oxide containing 10% of antimony oxide, 25 parts of phenolic resin, 20 parts of methyl cellosolve, 5 parts of methanol and 0.002 part of silicone oil (polyldimethylsiloxanepolyoxyalkylene copolymer, Mw (average molecular weight)=3000) were subjected to 2 hours of mixing-dispersion in a sand mill apparatus containing 1 mm-dia. glass beads to form a paint for electroconductive layer.

The above paint was applied by dipping onto an aluminum cylinder having an outer diameter (OD) of 80 mm×a length (L) of 260 mm and dried at 140° C. for 30 min. to form a 20 micron-thick electroconductive layer.

Then, 10 parts of alcohol-soluble copolymer nylon (Mw=29000) and 30 parts of methoxymethylated 6-nylon resin (Mw=32000) were dissolved in a mixture solvent of methanol 260 parts and butanol 40 parts to form a coating liquid, which was applied onto the above electroconductive layer and dried at 90° C. for 10 min. to form a 0.5 micron-thick primer layer.

Then, 4 parts of a pigment of the formula below, 2 parts of polyvinyl butyral and 34 parts of cyclohexanone were dispersed for 12 hours in a sand mill containing 1 mm-dia. glass beads. The resultant dispersion was diluted with a mixture solvent of cyclohexanone 200 parts and tetrahydrofuran (TH) 200 parts and applied onto the primer layer, followed by 30 min. of drying at 120° C., to form a 0.15 micron-thick charge generation layer.

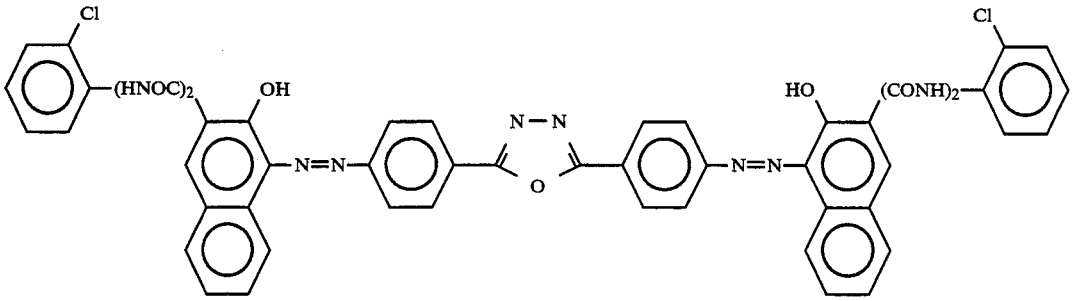

Separately, 10 parts of a styryl compound of the formula shown below and 10 parts of polycarbonate (Mw=46000) were dissolved in a mixture solvent of dichloromethane 10 parts and monochloromethane 40 parts. The resultant solution was applied by dipping onto the charge generation layer, followed by 30 min. of drying at 120° C., to form a 18 micron-thick charge transport layer.

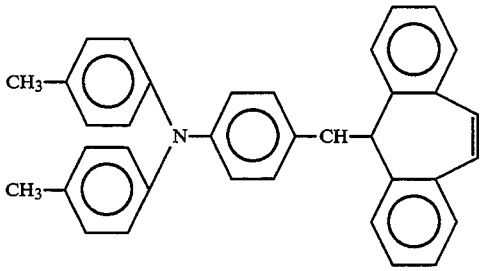

Separately, 10 parts of photoionically polymerizable compound No. 2 (1,4-diglycidyl-n-butane) shown in Table 2 and 0.5 part of triphenylsulfonium hexafluoroantimonate were dissolved in 60 parts of toluene and 60 parts of methyl ethyl ketone to form a coating liquid.

The coating liquid was applied by spraying onto the above charge transport layer, dried at 120° C. for 30 min. and cured by 30 sec. of irradiation with ultraviolet rays at an intensity of 20 mW/cm$^2$ from a 2 kV-high pressure mercury lamp while rotating the coated cylinder at a speed of 10 rpm, thereby to form a 1.5 micron-thick protective layer.

The thus prepared electrophotographic photosensitive member was incorporated in a copying machine of normal development-type wherein a process of charging-exposure-development-transfer-cleaning was performed in a cycle of 1.5 sec. In this way, electrophotographic performances were evaluated and further a durability test including 20000 times of successive image formation was performed.

As a result, compared with a case using a photosensitive member having no protective layer (Comparative Example 1 described after), the sensitivity and residual potential characteristic were on the same level, but stable images free from image irregularity or black spots could be obtained even after the durability test.

The results are shown in Table 3, wherein the dark part potential represents a surface potential of a photosensitive member charged at a corona discharge voltage of +5 kV. A larger value represents a larger chargeability. The sensitivity indicates an exposure quantity required for causing an attenuation of surface potential of from 700 volts to 200 volts.

EXAMPLES 2 and 3

Photosensitive members were prepared and evaluated in the same manner as in Example 1 except that the photoionically polymerizable compound was replaced by Compound No. 11 (2,2-butylidene-bis(4-glycidyloxybenzene) - Example 2) or Compound No. 18 (Example 3) to form a 1.0 micron-thick protective layer.

EXAMPLE 4

The procedure in Example 1 was repeated up to the formation of the charge transport layer. Then, a coating liquid was prepared by dissolving 3 parts of polycarbonate resin (Mw=35000) in 60 parts of toluene and then dissolving 3 parts of the photoionically polymerizable compound used in Example 2 and 0.015 part of the photopolymerization initiator used in Example 1. A 2.0 micron-thick protective layer was formed in the same manner except for using the thus prepared coating liquid.

EXAMPLE 5

A laminate photosensitive layer was formed by reversing the order of formation of the charge transport layer and the charge generation layer. Then, 2 parts of alcohol-soluble copolymer nylon resin (Mw=29000) and 6 parts of methoxymethylated 6-nylon resin (Mw=32000) were dissolved in a mixture solvent of methanol 200 parts and butanol 200 parts to form a coating liquid, which was then applied by spraying onto the above charge generation layer and dried at 90° C. for 10 min. to form a 0.5 micron-thick intermediate layer.

Then, a protective layer was formed by application and film formation in the same manner as in Example 1 to prepare a photosensitive member, which was evaluated in a similar manner as in Example 1. The results are also shown in Table 3.

EXAMPLE 6

An aluminum cylinder was successively coated with an electroconductive layer, a primer layer and a charge generation layer in this order in the same manner as in Example 1.

Then, 10 parts of the styryl compound used in formation of the charge transport layer in Example 1, 10 parts of photoionically polymerizable compound No. 21 shown in Table 2 and 0.5 part of triphenylsulfonium hexafluoroantimonate were dissolved in a mixture solvent of dichloromethane 20 parts and monochlorobenzene 20 parts to form a coating liquid. The coating liquid was applied by dipping onto the above charge generation layer and dried at 120° C. for 30 min. The coating layer on the aluminum cylinder was irradiated for curing for 5 sec. with ultraviolet rays at an intensity of 20 mW/cm$^2$ from a high-pressure mercury lamp while rotating the cylinder at a speed of 60 rpm. The coated cylinder was further heated for 1 hour at 80° C. to form a 15 micron-thick charge transport layer.

The thus prepared photosensitive member was evaluated in the same manner as in Example. The results are also shown in Table 3.

EXAMPLE 7

An electroconductive layer and a primer layer were formed on an aluminum cylinder in the same manner as in Example 1.

Then, 10 parts of a triarylamine compound of the formula below:

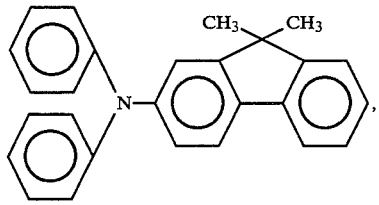

1.5 parts of a disazo pigment of the formula shown below:

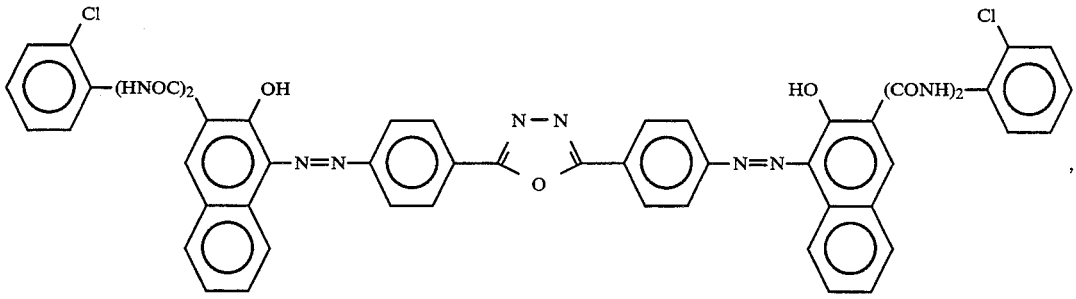

10 parts of photoionically polymerizable compound No. 19 and 0.5 part of triphenylsulfonium hexafluoroantimonate were subjected to 24 hours of mixing and dispersion together with a mixture solvent of dichloromethane 20 parts and monochlorobenzene 20 parts in a sand mill to form a coating liquid. The coating liquid was applied by dipping onto the above primer layer, dried at 80° C. for 1 hour and irradiated for 5 sec. with ultraviolet rays at an intensity of 30 mW/cm$^2$ from a high-pressure mercury lamp to form a cured coating layer, which was further heated at 80° C. for 1 hour to form a 15 micron-thick photosensitive layer.

The thus prepared photosensitive member was evaluated in the same manner as in Example 5. The results are also shown in Table 3.

EXAMPLE 8

An electroconductive layer and a primer layer were formed on an aluminum cylinder in the same manner as in Example 1, and further a 18 micron-thick charge transport layer was formed in the same manner as in Example 1. Separately, the coating liquid used for preparing the photosensitive layer in Example 7 was diluted with 50 parts of monochlorobenzene to form a coating liquid, which was then applied by spraying onto the above charge transport layer, dried at 120° C. for 1 hour and then irradiated for 10 sec. with ultraviolet rays at an intensity of 30 mW/cm$^2$ from a high-pressure mercury lamp to form a cured layer. The cured layer was further heated at 80° C. for 1 hour to form a 7 micron-thick photosensitive layer containing both a charge generation substance and a charge transport substance.

The thus prepared photosensitive member was evaluated in the same manner as in Example 5. The results are shown in Table 3.

COMPARATIVE EXAMPLE 1

A photosensitive member was prepared in the same manner as in Example 1 except that no protective layer was formed.

COMPARATIVE EXAMPLE 2

The procedure in Example 1 was repeated up to the formation of the charge transport layer. Then, 7 parts of polycarbonate resin (Mw=46000) was dissolved in a mixture solvent of toluene 60 parts and methyl ethyl ketone 60 parts to form a coating liquid. The coating liquid was applied by spraying onto the above charge transport layer and dried at 120° C. for 60 min. to form a 2 micron-thick surface protective layer.

The photosensitive members prepared in Comparative Examples 1 and 2 were evaluated in the same manner as in Example 1. The results are also shown in Table 3 below.

TABLE 3

| Example No. | Surface layer: Monomer/Binder | Surface layer: Thickness (μm) | Electrophotographic characteristics: Dark potential (volts) | Electrophotographic characteristics: Sensitivity (lux. sec) | Electrophotographic characteristics: Residual potential (volts) | Image evaluation: Initial | Image evaluation: After durability test *1 |
|---|---|---|---|---|---|---|---|
| Ex. | | | | | | | |
| 1 | Compound No. 2 | 1.5 | −960 | 2.0 | 45 | Good | Good |
| 2 | Compound No. 11 | 1.0 | −960 | 2.0 | 50 | " | " |
| 3 | Compound No. 18 | 0.3 | −945 | 2.2 | 40 | " | " |
| 4 | Polycarbonate + Compound No. 11 | 2.0 | −970 | 2.3 | 45 | " | " |
| 5 | Compound No. 2 | 1.5 | +950 | 2.0 | 30 | " | " |
| 6 | Compound No. 21 | 15 | −950 | 2.5 | 50 | " | " |
| 7 | Compound No. 19 | 15 | +905 | 2.8 | 60 | " | " |
| 8 | Compound No. 19 | 7 | +930 | 2.6 | 30 | " | " |
| Comp. Ex. | | | | | | | |
| 1 | — | — | −870 | 1.9 | 20 | " | image defect *2 |
| 2 | Polycarbonate | 2.0 | −930 | 4.3 | 160 | ground stain | image defect *3 |

*1: Successive copying of 20000 sheets.
*2: Occurred at 10000 sheets,
*3: Occurred at 5000 sheets.

What is claimed is:

1. An image-bearing member for electrophotography, comprising a surface layer gapable of repeatedly forming electrophotographic images thereon, said surface layer comprising a polymerized and cured product of a photoionically polymerizable compound having two or more functional groups.

2. An image-bearing member according to claim 1, wherein said photoionically polymerizable compound is selected from the group consisting of epoxides, vinyl ethers, vinyls having a polar group, cyclic ethers, thioxy-silane rings, and cyclic polyorganosiloxanes.

3. An image-bearing member according to claim 1 or 2, wherein said surface layer constitutes a protective layer.

4. An image-bearing member according to claim 3, wherein said image-bearing member includes at least a photoconductive layer.

5. An image-bearing member according to claim 4, wherein said photoconductive layer is an organic photoconductive layer.

6. An image-bearing member according to claim 5, wherein said organic photoconductive layer has a laminate structure including a charge generation layer and a charge transport layer.

7. An image-bearing member according to claim 1 or 2, wherein said surface layer constitutes an organic photoconductive layer.

8. An image-bearing member according to claim 7, wherein said organic photoconductive layer is a charge transport layer.

9. An image-bearing member according to claim 7, wherein said organic photoconductive layer is a charge generation layer.

10. An apparatus unit, comprising:

an image-bearing member for electrophotography, comprising a surface layer capable of repeatedly forming electrophotographic images thereon, said surface layer comprising a polymerized and cured product of a photoionically polymerizable compound having two or more functional groups; and at least one of a charging means, a developing means, and a cleaning means integrally supported with said image-bearing member to form a single unit, which can be connected to or released from an apparatus body as desired.

11. An apparatus according to claim 10, wherein said photoionically polymerizable compound is selected from the group consisting of epoxides, vinyl ethers, vinyls having a polar group, cyclic ethers, thioxy-silane rings, and cyclic polyorganosiloxanes.

12. An electrophotographic apparatus, comprising:

an image-bearing member for electrophotography, comprising a surface layer capable of repeatedly forming electrophotographic images thereon, said surface layer comprising a polymerized and cured product of a photoionically polymerizable compound having two or more functional groups;

a means for forming a latent image;

a means for developing the latent image; and a means for transferring the developed image onto a transfer-receiving member.

13. An apparatus according to claim 12, wherein said photoionically polymerizable compound is selected from the group consisting of epoxides, vinyl ethers, vinyls having a polar group, cyclic ethers, thioxy-silane rings, and cyclic polyorganosiloxanes.

14. A facsimile apparatus, comprising:

a receiving means for receiving image data from a remote terminal; and an electrophotographic apparatus, comprising an image-bearing member for electrophotography, comprising a surface layer capable of repeatedly forming electrophotographic images thereon, said surface layer comprising a polymerized and cured product of a photoionically polymerizable compound having two or more functional groups;

a means for forming a latent image;

a means for developing the latent image; and a means for transferring the developed image onto a transfer-receiving member.

15. A facsimile apparatus according to claim 14, wherein said photoionically polymerizable compound is selected from the group consisting of epoxides, vinyl ethers, vinyls having a polar group, cyclic ethers, thioxy-silane rings, and cyclic polyorganosiloxanes.

* * * * *

UNITED STATES PATENT AND TRADEMARK OFFICE

CERTIFICATE OF CORRECTION

PATENT NO. : 5,352,552

DATED : October 4, 1994

INVENTOR(S) : AKIO MARUYAMA, ET AL.

It is certified that error appears in the above-identified patent and that said Letters Patent is hereby corrected as shown below:

ON TITLE PAGE

In [75] Inventors: "Shin Nagahara, Tokyo;" should read --Shin Nagahara, Inagi;--.

In [56] References Cited, under FOREIGN PATENT DOCUMENTS: "60-5535 3/1985 Japan" should read --60-55356 3/1985 Japan--.

COLUMN 3

Line 6, "polymerization and curing" should read --polymerized and cured--.

COLUMN 5

TABLE 1-continued,
"$\text{-}\!\!\left[ CH_2)_4\text{-}O \right]_n$" should read --$\text{-}\!\!\left[ (CH_2)_4\text{-}O \right]_n$-- and
"$\text{-}\!\!\left[ CH_2)_3\text{-}O \right]_n$" should read --$\text{-}\!\!\left[ (CH_2)_3\text{-}O \right]_n$--.

COLUMN 15

Line 48, "anthoanthrone" should read --anthanthrone--.

COLUMN 16

Line 4, "men%her" should read --member--.
Line 13, "men%her" should read --member--.

COLUMN 17

Line 57, "described" should read --is described--.

UNITED STATES PATENT AND TRADEMARK OFFICE

CERTIFICATE OF CORRECTION

PATENT NO. : 5,352,552

DATED : October 4, 1994

INVENTOR(S) : AKIO MARUYAMA, ET AL.

It is certified that error appears in the above-identified patent and that said Letters Patent is hereby corrected as shown below:

COLUMN 21

Line 39, "a 18" should read --an 18--.

COLUMN 22

Line 32, "gapable" should read --capable--.

COLUMN 24

Line 7, "comprising" should read --comprising:--.

Signed and Sealed this

Eighteenth Day of April, 1995

Bruce Lehman

*Attest:*

BRUCE LEHMAN

*Commissioner of Patents and Trademarks*

*Attesting Officer*